US007661359B2

(12) United States Patent
Eckert

(10) Patent No.: US 7,661,359 B2
(45) Date of Patent: Feb. 16, 2010

(54) PRINTING MACHINE COMPRISING A FORMER

(75) Inventor: Günther Oskar Eckert, Zellingen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 339 days.

(21) Appl. No.: 10/585,449

(22) PCT Filed: Jan. 4, 2005

(86) PCT No.: PCT/EP2005/050011

§ 371 (c)(1),
(2), (4) Date: Jul. 7, 2006

(87) PCT Pub. No.: WO2005/065949

PCT Pub. Date: Jul. 21, 2005

(65) Prior Publication Data

US 2008/0156209 A1 Jul. 3, 2008

(30) Foreign Application Priority Data

Jan. 9, 2004 (DE) ..... 10 2004 001 399

(51) Int. Cl.
*B41F 13/56* (2006.01)

(52) U.S. Cl. ..... 101/227; 101/226; 270/5.01; 270/20.1; 270/21.1

(58) Field of Classification Search ..... 101/227, 101/219, 226; 270/4, 5.01, 6, 5.02, 5.03, 270/10, 20.1, 21.1
See application file for complete search history.

(56) References Cited

U.S. PATENT DOCUMENTS 1,709,386 A * 4/1929 Zuckerman ..... 270/8
2,463,769 A 3/1949 Higgins
4,079,928 A * 3/1978 Weschenfelder et al. ..... 270/4
4,538,517 A 9/1985 Michalik et al.
6,029,968 A 2/2000 Honegger
6,827,012 B1 * 12/2004 Palmatier ..... 101/225

(Continued)

FOREIGN PATENT DOCUMENTS

DE 2 039 844 8/1971

(Continued)

*Primary Examiner*—Ren Yan
(74) *Attorney, Agent, or Firm*—Jones, Tullar & Cooper, P.C.

(57) ABSTRACT

A printing machine includes a printing cylinder that is fitted with plates for printing the width of N pages. A web of material is printed and is then cut longitudinally, by an elongate cutting device, into printed webs. The number N of pages is a whole number that is divisible by three and the total width of N pages is less than the width of the printing cylinder. A width of N+1 pages is greater than the width of the printing cylinder. The elongate cutting device can be arranged, on one boundary, between a $K^{th}$ and a $K^{th}+1$ page, wherein k is one third or two thirds of N. At least one of the resulting partial webs is guided through a former. The former is oriented so that the direction of travel of the web entering the former is transverse to the direction of web travel in the elongated cutting device. The former has a width that is equal to, or greater than two thirds of the width of the printing cylinder, but is less than the entire width of the printing cylinder.

20 Claims, 4 Drawing Sheets

U.S. PATENT DOCUMENTS

| | | | | |
|---|---|---|---|---|
| 2004/0244615 | A1 * | 12/2004 | Herbert et al. | 101/227 |
| 2005/0172841 | A1 | 8/2005 | Goto | |

FOREIGN PATENT DOCUMENTS

| | | | |
|---|---|---|---|
| DE | 32 37 504 | | 7/1985 |
| EP | 0 814 044 | | 12/1997 |
| EP | 1 477 311 | | 11/2004 |
| GB | 325343 | | 2/1930 |
| GB | 352003 | | 7/1931 |
| WO | WO 03/031179 | * | 4/2003 |

* cited by examiner

PRINTING MACHINE COMPRISING A FORMER

CROSS-REFERENCE TO RELATED APPLICATIONS

This patent application is the U.S. National Phase, under 35 USC 371, of PCT/EP2005/050011, filed Jan. 4, 2005; published as WO 2005/065949 A1 on Jul. 21, 2005, and claiming priority to DE 10 2004 001 399.3, filed Jan. 9, 2004, the disclosures of which are expressly incorporated herein by reference.

FIELD OF THE INVENTION

The present invention is directed to a printing press. The printing press is equipped with at least one forme cylinder that is used to print a web of material, and at least one longitudinal cutting device.

BACKGROUND OF THE INVENTION

A folding structure of a printing press is known, for example, from W. Walenski "Der Rollenoffsetdruck" [Rotary Offset Printing], 1996, pages 186 and 187, in which a web of material is cut into two partial webs. During a further course of production of the printed product, the partial webs are placed on top of each other and are cut, either in the center, or are again cut longitudinally. In such a case, as discussed in Walenski, at page 81, the width of the pages of four page wide webs, which pages are imprinted side-by-side, would each be a quarter of the width of the printing cylinder, or could be slightly less, if a web of lesser width than that of the printing cylinder is to be imprinted.

If the number of pages of a printed product to be produced is not sufficient to fill four pages side-by-side, the plate cylinder can also be equipped with a reduced number of printing plates. This will equip it for printing a web of three-quarter width or of half width or of one quarter width side-by-side with three, two or one rape. At least a quarter of the width of the plate cylinder, and therefore at least a quarter of the production capacity of the press remains unused in each such case.

If such a press is to be used for semi-commercial printing in particular, various printing jobs, with unfavorable page formats, may need to be printed, in which, in such unfavorable page formats, four pages side-by-side are wider than the plate cylinder, or in which unfavorable page formats, with four pages placed side-by-side, the entire width of the plate cylinder is insufficiently utilized, but in which unfavorable format twice the number of pages to be printed would exceed the width of the plate cylinder.

EP 0 814 044 A1 discloses a web guidance of several partial webs. The partial webs are cut by a longitudinal cutting device located in the direction of web travel to a former. The former is oriented in such a way that its entry direction extends transversely with respect to the web running direction in the area of the longitudinal cutting device.

DE 20 39 544 B shows a web guidance in a printing press and having a longitudinal web cutting device which is positioned in such a way that it cuts a web into a ⅓ and a ⅔ partial web. The two partial webs are conducted to a former which can be moved transversely with respect to the web running direction.

SUMMARY OF THE INVENTION

The object of the present invention is directed to providing a printing press with an improved utilization of the web width.

In accordance with the present invention, this object is attained by providing the printing press with at least one forme cylinder that is used for imprinting a web. At least one longitudinal cutting device is provided for cutting the web. The forme cylinder is equipped with a defined number of printing plates and the longitudinal cutting device can be placed on a boundary between selected ones of the plates. At least one of the partial webs is conducted through a former having an entry direction which is transverse to the direction of web travel. The effective width of the former is a function of the width of the forme cylinder.

In generally known printing presses, the longitudinal division of an original web of material into partial webs of one or two thirds of the original web width is only intended in connection with webs of material or with webs which originally were three quarters wide, in other words with webs which maximally cover three quarters of the width of the plate cylinder. The printing press of the present invention is configured to provide such a three quarter web division which can be accomplished also in connection with wider webs. In an optimum case, the entire width of the plate cylinders is used for printing a number of side-by-side pages, which number of plates can be divided by three.

In this case, at least one of the partial webs can be conducted through a former. In the course of its passage through the former, the web of material is folded longitudinally in the center. It is possible to provide at least one longitudinal cutting device in an apex of the former for use in cutting at least one folded partial web in the longitudinal direction of its fold line.

The printing press preferably has a transverse cutter that is usable for cutting the partial webs into signatures.

The printing press can also be provided with a folding apparatus. The folding apparatus can be, for example, a transverse folding apparatus, such as a folding jaw cylinder or it can be some other generally known device for accomplishing a transverse folding of the web. In this case the transverse cutter can be a cutting blade cylinder which can be placed against a folding jaw cylinder of the folding apparatus.

Moreover, the printing press can have a stapling device for stapling signatures to produce stapled products.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
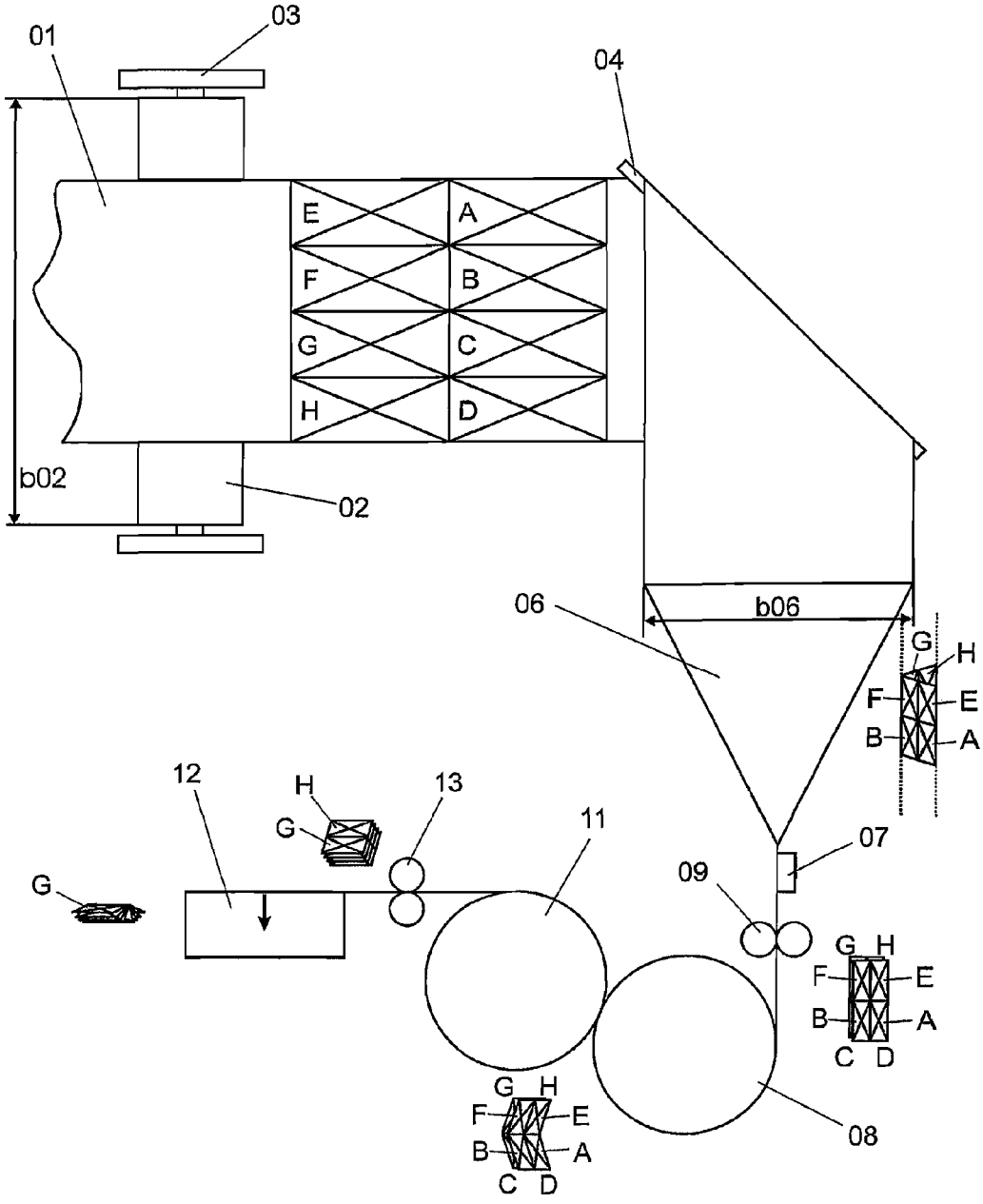
PRIOR ART Fig. 1
FIG. 1, a schematic representation of a portion of a generally known printing press, in FIG. 2, a schematic representation of a portion of a first preferred embodiment of a printing press in accordance with the present invention, in FIG. 3, a schematic representation of a portion of a second preferred embodiment of a printing press, and in FIG. 4, a schematic representation of a portion of a third preferred embodiment of a printing press in accordance with the present invention.

A portion of a generally known printing press, depicted in the course of performing a semi-commercial printing job, is schematically represented in FIG. 1. Products having a lateral width of 8 inches, or of 203.2 mm are produced from a web 01 of material, and in particular from a paper web 01, or from a web 01, of a width of 32 inches, or 812.8 mm by use of the printing press. The web 01 of material is conducted over a printing cylinder 02, such as, for example, a forme cylinder 02, which forme cylinder 02 is rotatably seated in a frame 03. Forme cylinder 02 can be a plate cylinder 02 or, in the context of an indirect printing process, it can be a transfer cylinder 02 which rolls off in contact with a plate cylinder 02. A counter-pressure cylinder, which presses the web 01 of material against the printing cylinder 02, is not represented in FIG. 1. To imprint the web 01 of material, a circumference of the plate cylinder 02 is equipped with two sets of printing plates. Each such set of printing plates is four printing plates wide. Therefore, eight fields A, B, C, D, E, F, G, H, with each such field respectively corresponding to a printing plate, can be imprinted on the web 01 of material, during the course of each full revolution of the plate cylinder 02. The fields A, B, C, D are printed by the printing plates of the first set of printing plates. The fields E, F, G, H are printed by the printing plates of the second set. In FIG. 1 the fields A, B, C, D, E, F, G, H, which are imprinted on the web 01 of material during each revolution of the printing cylinder, are indicated by diagonally crossed and appropriately labeled rectangles.

The now printed web 01 of material is then conducted over a turning bar 04 and into a former 06. In the former 06, the web 01 is folded longitudinally along a center line. The effect of the former 06 on the fields A, B, C, D, E, F, G, H is illustrated in FIG. 1 to the side of the former. A longitudinal fold is formed between the fields B and C and between the fields G and F.

A longitudinal cutting device 07 is arranged in an apex of the former 06, and following, in a direction of web travel, the former 06. The cutting device 07 can be switched in, or engaged, as needed, in order to cut the web 01 of material, along the longitudinal fold, into two partial webs of identical width, which can then be placed on top of each other. These two partial webs are then divided into signatures, each with two sheets, in a transverse cutter 09, which is constituted by a cutting blade cylinder and a counter-pressure cylinder, which two cylinders rotate together. A first one of these sheets comprises the fields A, B, E, F, and a second one of these sheets comprises the fields C, D, G, H. In these signatures, the sheets lie on top of each other in such a way that the fields A and D, B and C, E and H, as well as F and G are respectively congruent, as can be seen in the small representation next to the transverse cutter 09.

The now cut signatures arrive at a cylinder 08, such as, for example, a spur needle and folding blade cylinder 08 which, in a manner which is generally known, is provided with spur strips or with similar grippers for use in holding the signatures, as well as with folding blades. The signatures held on the cylinder 08 are transferred, by orientation of the spur needle and folding blade cylinder 08, to a cylinder 11, such as, for example, a folding jaw cylinder 11, which folding jaw cylinder 11 has been placed against the spur needle and folding blade cylinder 08. In the course of this transference, the transverse folding of the signatures is performed with a transverse fold line being formed in the first sheet between the fields A and E, as well as between the fields B and F, and in the second sheet between the fields C and G and between D and H. This transverse fold is shown in the small drawing figure situated next to the cylinders 08, 11 in FIG. 1.

A second transverse cutter 13, which is equivalent to the first transverse cutter 09, adjoins the cylinders 08, 11 and cuts the signatures along the transverse fold edges. The result of this cut is four sheets placed on top of each other, each sheet being provided with respectively two fields. Here, too, a small drawing adjacent the second transverse cutter 13 shows the situation following the passage through the second transverse cutter 13. Here, the sheet shown on top comprises the fields G and H.

A folding apparatus 12 follows the second transverse cutter 13, in which folding apparatus 12 the signatures are once more longitudinally folded. Here, the longitudinal fold takes place between the respective fields of each of the sheets of the signature, which longitudinal folding is also illustrated by a small drawing adjacent the folding apparatus 12, as seen in FIG. 1. In this way, products with four longitudinally folded sheets and with 16 pages are made.

Figure 2:
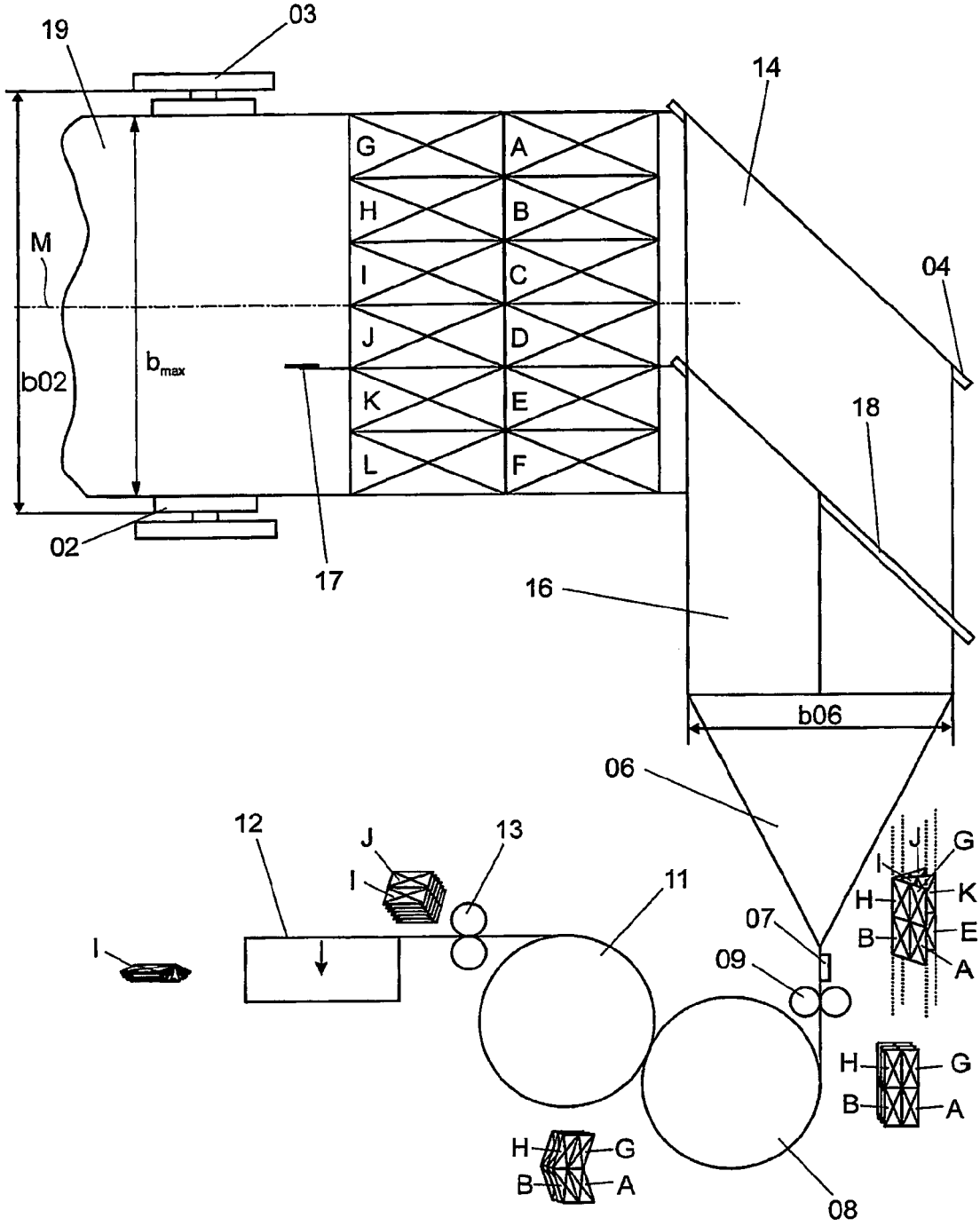

As can be seen in FIG. 1, the printing press, and specifically the printing cylinder 02, is configured for processing webs of material which are wider than the depicted web 01 of material, which is provided having a width of 32 inches. An unused projection of the printing cylinder 02, which has a usable width b02 of its barrel remains on both sides of the web 01 of material, again as seen in FIG. 1. The width, or the usable width b02 of the cylinder 02 should be understood to be its width which represents a maximum printing or ink transfer area. In the case of a transfer cylinder, for example, this usable width can be the maximum width which can be covered with transfer blankets. In the case of forme cylinders, the usable width is the maximal width which can be covered with print images. Not included in this usable width are journals, a possibly additionally provided bearer ring width, or other auxiliary devices. The usable width substantially also corresponds to a maximum width of a web which is possible to be processed, or a maximal width $b_{max}$ of the web 19 to be processed, as seen in FIG. 2. The maximum web width, $b_{max}$, is either negligibly less than the width b02 of the cylinder 02, which is embodied as forme cylinder 02 or, in the extreme case, corresponds to it. If it were desired to produce a product of a page width of 8 inches from a wider web of material, by the use of the printing press represented in FIG. 2, in order to also utilize this projection, this wider web of material would have to be wider by four pages of the product, i.e. would have to have a total width of 64 inches, or of 1,625.6 mm. However, this total web width would exceed the width of the printing cylinder 02 and could no longer be processed in the depicted printing press. Therefore, with the depicted printing press, the production of a product of 8 inch page width is tied to the use of a web 01 of material of a maximum web width of 32 inches. To accommodate this use, a large projection of the printing cylinder 02 on both sides of the web 01 of material must be accepted.

A corresponding portion of a printing press is represented schematically in FIG. 2. The same reference symbols in FIG. 2 identify identical components as they do in FIG. 1. In contrast to FIG. 1, a wider web 19 of material, having a width of 48 inches or 1,219.2 mm, is processed in the printing press depicted in FIG. 2. Two sets of printing plates, arranged over the width of cylinder 02, have again been attached to the plate cylinder 02. However, in FIG. 2 the two sets of printing plates comprise n=6 printing plates per set. In this case, the number of printing plates n of a set, i.e. the number of pages over the width of the printing cylinder 02, has been selected in such a way that n is a whole number which is divisible by 3. In this way, twelve fields A, B, C, D, E, F, G, H, I, J, K, L, for each revolution of the printing cylinder 02, are imprinted on the web 19 of material. The fields A, B, C, D, E, F are printed by the printing plates of the first set. The fields G, H, I, J, K, L are printed by the printing plates of the second set.

A longitudinal cutting device 17 is provided after the printing cylinder 02, and which cuts the web 19 of material into a wide partial web 14 and a narrow partial web 16. The wide partial web 14 has a width of 32 inches, which width corresponds to two-thirds of the overall width of the web 19 of material. The narrow partial web 16 has a width of 16 inches or 406.4 mm, which corresponds to one third of the overall width of the web 19 of material. If the fields A, B, C, D, E, F, G, H, I, J, K, L, which are imprinted by a set of printing plates, are consecutively numbered from the bottom to the top in the drawing shown in FIG. 2, the longitudinal cutting device 17 has been placed on a boundary between the second and third field, i.e. between fields E and D of the fields A, B, C, D, E, F imprinted by the first set of printing plate, and between the fields K and J of the fields G, H, I, J, K, L imprinted by the second set of printing plates. Therefore, the fields A, B, C, D, G, H, I, J are part of the wide partial web 14, while the fields E, F, K, L are part of the narrow partial web 16.

The wide partial web 14 is conducted over a first turning bar 04, while the narrow partial web 16 is conducted over a second turning bar 18 in such a way that both of the partial webs 14 and 16 pass through the former 06. In former 06 the wide partial web 14 is folded along its longitudinal center between the fields H and I and between the fields B and C. The narrow partial web 16 passes through the former 06 without being folded or otherwise changed. FIG. 2 is also provided, in a manner the same as FIG. 1, with small drawings on the side of the main drawing for making the position of the fields A, B, C, D, E, F, G, H, I, J, K, L during the various process steps clear. In the case of the printing press represented in FIG. 2, the folded wide partial web 14 encloses the unfolded narrow partial web 16 after both of their passage through the former 06. It is also possible for the unfolded, narrow partial web 16 to be conducted outside the folded wide partial web 14.

At least one of the two turning bars 04, 18, in this case at least the first turning bar 04, but advantageously both turning bars 04, 18, has, or have, an effective length which is suitable for the deflection of at least two-thirds of the width $b_{max}$ of the wide partial web 14 maximally corresponding to the web 19 to be processed. The effective length of the turning bar is here understood to be the resultant length from the projection of the incoming partial web onto the turning bar 04, 06, which is inclined by 45° or 135° with respect to the entry direction, i.e. the length which is required for deflecting the respective partial web 19, here of three quarter width. If both turning bars 04, 18 are embodied in this way, the variability regarding the assignment of the two-thirds width wide partial web 14 to the turning bar 04 or 18 and/or to the positioning of the cutting line between D and E or between B and C is increased.

Following its passage through the former 06, the wide partial web 14, which is now folded, is transversely cut at the fold location by the longitudinal cutting device 07, the same as was described in the previous example in connection with FIG. 1 so that, in contrast to the printing press in FIG. 1, in the present printing press depicted in FIG. 2, three partial webs, which are placed on top of each other, and are of respective widths corresponding to two pages, each of 16 inches or 50.8 mm. These three partial webs are transferred to the traverse cutter 09. Further processing takes place in a manner which is analogous to the printing press described in connection with FIG. 1. A longitudinally folded signature with six sheets and 24 pages leaves the printing press as the finished product.

In contrast to the known printing press depicted and described in FIG. 1, by processing a wider web 19 of material it is therefore possible for the printing press in accordance with the present invention to make a product which also has a page width of 8 inches. The resultant products have a larger number of sheets and pages. Therefore, the printing press is also more efficient with regard to the amount of product pages it produces per cylinder revolution, than is the printing press that is known from FIG. 1. Furthermore, with the printing press of the present invention, the projection of the cylinder 02 on both sides of the web 19 of material is reduced, so that the printing press is utilized much more effectively than the known printing accomplished by the printing press shown in FIG. 1.

Figure 3:
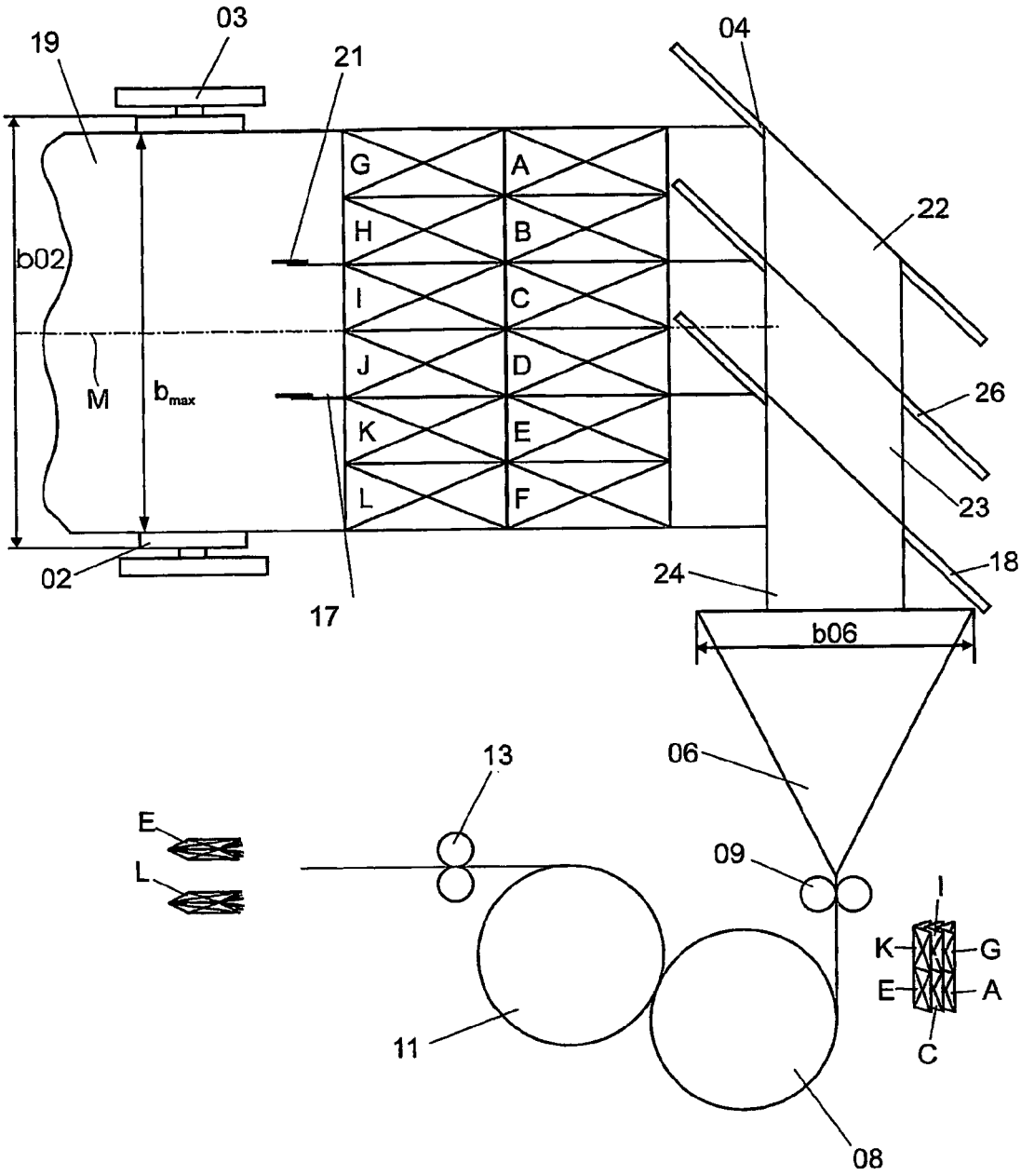

A second embodiment of a printing press in accordance with the present invention is represented in FIG. 3. The printing press depicted in FIG. 3 has two longitudinal cutting devices 17 and 21, which cut the web 19 of material into three partial webs 22, 23, 24, each of identical width. As in the previous example described and depicted in connection with FIG. 2, the first longitudinal cutting device 17 has been placed at the boundary between the second and third fields, i.e. between fields E and D and between fields J and K. The second longitudinal cutting device 21 has been placed at a boundary between the fourth and fifths fields, i.e. between fields B and C and between fields H and I. Each width of the resultant partial webs 22, 23, 24 corresponds to a width of two printing plates of two pages wide. The first partial web 22 comprises the fields A, B, G, H, the second partial web 23 comprises the fields C, D, I, J, and the third partial web 24 comprises the fields E, F, K, L.

The first partial web 22 is conducted over the turning bar 04, the second partial web 23 is conducted over the turning bar 26 and the third partial web 24 is conducted over the turning bar 18. All three of the partial webs 22, 23, 24 subsequently pass through the former 06. In contrast to the printing press in FIG. 2, in the second preferred embodiment depicted in FIG. 3, no longitudinal cutting device is required following the former 06. The three partial webs 22, 23, 24 are each only folded along the center in the former 06, are then cut into signatures, in this state, by the transverse cutter 09 and are then transferred to the spur needle and folding blade cylinder 08. Here, the resultant signature is transversely folded, the same as was done in the previous examples. After this transverse folding, the signature is cut open at the transverse fold by the transverse cutter 13. The printing press represented in FIG. 3 delivers two longitudinally folded signatures simultaneously, each of which signatures comprises three sheets and twelve pages.

Figure 4:
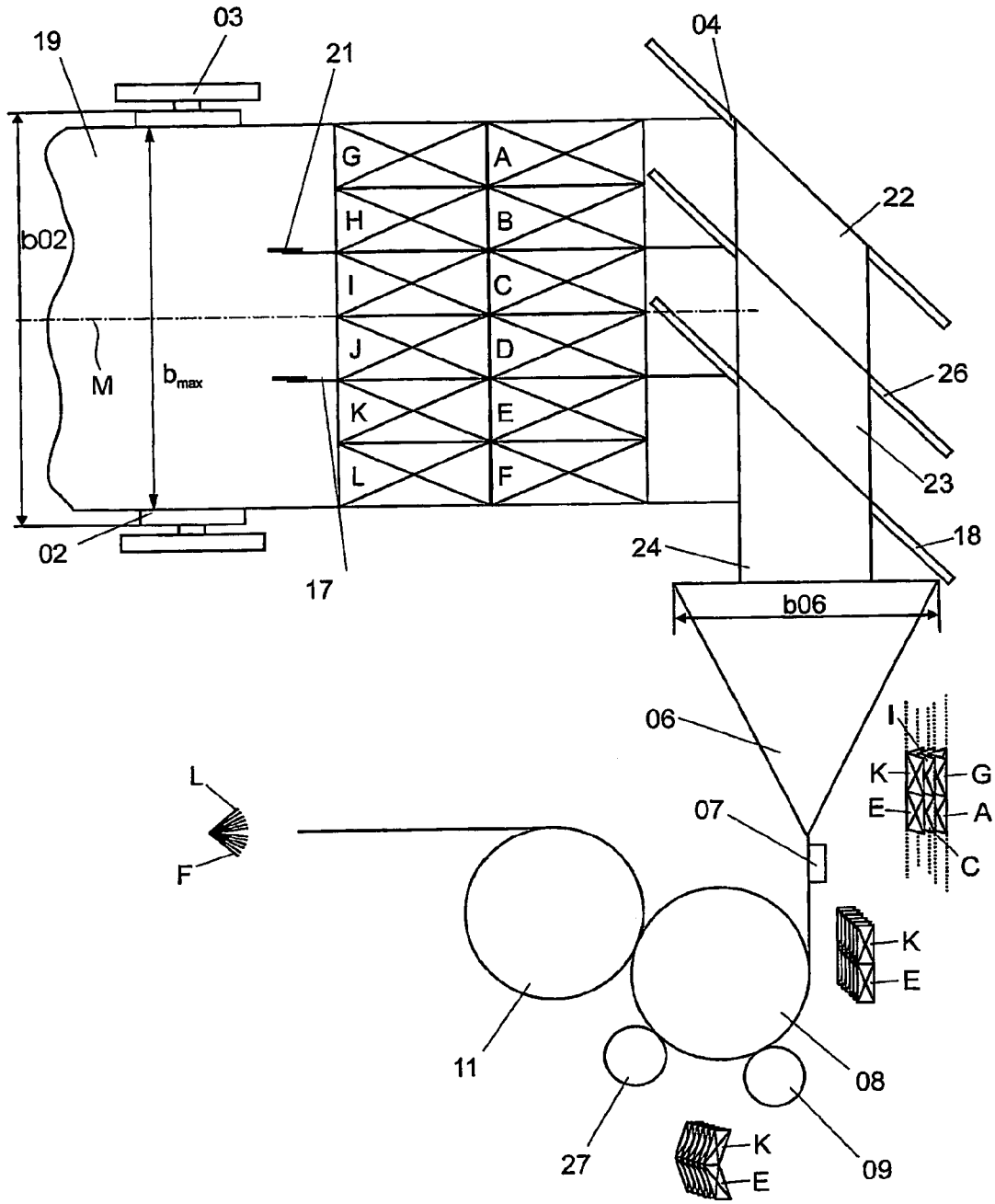

Finally, a modification of the printing press in FIG. 3 is represented in FIG. 4 in which, following the former 06, there is provided a longitudinal cutting device 07, in a manner that is the same as in FIGS. 1 and 2, and which longitudinal cutting device 07 cuts the partial webs 22, 23, 24 after they leave the former 06. This produces six partial webs which have been placed on top of each other. A transverse cutter 09, which is placed against the spur needle and folding blade cylinder 08, cuts the six partial webs into signatures, each with six sheets. A stapling apparatus 27, which is also placed against the spur needle and folding blade cylinder 08, staples the sheets of a signature together along a line on which the signature is transversely folded in the course of its being transferred to the folding jaw cylinders 11. The finished product has six sheets stapled together and a total of 24 pages.

The printing press depicted in FIG. 3, as well as the printing press depicted in FIG. 2, both process a 48 inch wide web 19 of material. The printing press of FIG. 3 thus has the same advantages as the printing press in FIG. 2, namely a good utilization of the printing press and the possibility of providing products with a larger number of sheets, of a given page width of the product of 8 inches, than has been possible with the known printing press shown in FIG. 1.

As a generalization of the inventive concept of the subject invention, a printing press, with at least one forme cylinder 02 for imprinting a web 01, 19 of material, and having at least one longitudinal cutting device 07, 17, 21 for cutting the web 01, 19 of material into partial webs 14, 16, 22, 23, 24 is provided. The forme cylinder 02 is equipped with printing plates for n pages in width, wherein n is a natural number which is divisible by three, wherein n pages are less in width, and n+1 pages are larger in width than a width of the forme cylinder 02, and wherein the longitudinal cutting device 17, 21 can be placed on a boundary between a k-th and a k+1-th page, wherein k is one or two thirds of n.

In the embodiments of the present invention, as mentioned and described above, the former 06 is preferably oriented in such a way that its direction of entry extends transversely with respect to the web running direction in the area of the longitudinal cutting device 17, 21. In other words, its entry direction for the partial web 14, 16, 22, 23, 24, as viewed from above, substantially extends parallel with respect to the longitudinal axis of the former plate cylinder 02. In contrast to a straight guidance of the partial webs along, or parallel to the alignment direction M of the press, the partial web 14, 16, 22, 23, 24 is rerouted by approximately 90° with respect to this alignment direction M. Preferably, each imprinted web 01, 19, or each imprinted partial web 14, 16, 22, 23, 24 undergoes only one such directional change from the press alignment on its way from the printing group to the former 06. Simple deflections, by the use of deflection rollers with axes of rotation which are perpendicular in relation to the entry direction, are excluded from this.

Because of the arrangement of the former 06, which is turned by 90° with respect to the alignment direction M of the press, and because of the odd numbered, and in particular because of the one-time, deflection of the partial webs 14, 16, 22, 23, 24, it is possible, in an advantageous embodiment, to embody the former 06 as being stationary with respect to a direction extendingly transversely to the incoming partial web 14, 16, 22, 23, 24. In other words, lateral positioning of the former 06 is not necessary.

In connection with all of the above-described preferred embodiments, the former 06 can advantageously have an effective width b06 of at least half of the width $b_{max}$ of the maximum web width 01 to be processed. In other words, the former 06 has an effective width b06 of at least half a usable barrel length, or a usable width b02, of the forme cylinder 02. Preferably, the former 06 even has an effective width b06 of at least three-quarters of the usable width b02 or of the usable barrel length of the forme cylinder 02, or of the maximum width $b_{max}$. However, the former 06 is preferably embodied to be narrower than the entire usable width b02, or the barrel length of the forme cylinder 02, or of the maximum width $b_{max}$. In this case, the effective width 06 of the former 06 is to be understood as being the width of the former 06 transversely with respect to the entry direction of the partial webs 14, 16, 22, 23, 24, in the area of the run-up of these partial webs 14, 16, 22, 23, 24.

To ensure that, with a varying web or varying partial web width, the partial webs 14, 16, 22, 23, 24 running up on the former 06, which is turned by 90°, can be correctly laterally aligned, the turning bars can be moved horizontally or in the plane of the incoming and/or outgoing web in such a way that, with webs 01, 19 of different widths, the partial webs 14, 16, 22, 23, 24 that are made from them can be correctly aligned with respect to each other and/or with respect to the former tip.

The longitudinal cutting device 07 for use in accomplishing the longitudinal cutting of the folded partial web or webs, in the area of the fold back, can, in an embodiment, which is not specifically shown in FIGS. 2 and 4, be arranged, instead of upstream of the former 06, in the area of a traction roller that is arranged upstream of the former 06.

While preferred embodiments of a printing machine with a former, in accordance with the present invention, have been set forth fully and completely above, it will be apparent to one of skill in the art that various changes in, for example, the types of printing plates used on the printing cylinder, the drive for the printing cylinder and the like could be made without departing from the true spirit and scope of the present invention which is accordingly to be limited only by the appended claims.

What is claimed is:

1. A printing press adapted for imprinting a web of material and comprising:

a forme cylinder, said forme cylinder having a forme cylinder width and being equipped with printing plates of a number of N pages in width, said number N of pages being a natural number evenly divisible by three, said number N of pages having a combined page width less than said forme cylinder width, said number N of pages, plus one page having a width greater than said forme cylinder width, said printing plates being adapted to print said number of pages on said web of material and having a maximum web width equal to said combined page width;

at least one longitudinal web cutting device usable to cut the web of material, having said maximum web width, into at least first and second partial webs of said material, each of said at least first and second partial webs having a partial web width less than said maximum width of said web, one of said partial web widths being two-thirds of said maximum web width;

means for placing said at least one longitudinal web cutting device on a boundary between a $K^{TH}$ and a $K^{TH}$ plus one page printed on said web of material, wherein K is selected from one third and two thirds of N; and a former, at least one of said partial webs being conducted along a web path from said at least one longitudinal web cutting device and through said former for longitudinal folding of said at least one of said partial webs, said former having a former entry direction in an area of said at least one longitudinal web cutting device, said entry area extending transversely to a web running direction;

at least first and second turning bars in said web path between said at least one longitudinal web cutting device and said former; and an effective width of one of said at least first and second turning bars, said effective width being at least two-thirds of said maximum web width, said partial web of said width of two-thirds of said maximum web width being directed over this one of said at least first and second turning bars.

2. The printing press of claim 1 wherein said former has an effective former width at least as great as two thirds of said forme cylinder width, and less than said forme cylinder width.

3. The printing press of claim 1 wherein said at partial web of one third of said web of material width is centered on said former, said former having an effective former width of half of the web of material.

4. The printing press of claim 3 wherein said printed web of said web of material width is printed as two side-by-side vertical printed pages.

5. The printing press of claim 1 further including a further longitudinal cutting device located after, in a direction of web travel, said former and adapted for cutting said at least one partial web conducted through said former in a longitudinal direction of said at least one partial web.

6. The printing press of claim 1 further including at least one transverse cutter after, in a direction of web travel, said former.

7. The printing press of claim 6 further including a stapler associated with said at least one transverse cutter.

8. The printing press of claim 1 further including at least one folding apparatus after, in a direction of web travel, said former.

9. The printing press of claim 1 wherein said former has a width greater than two-thirds of, and less than said width of said forme cylinder.

10. The printing press of claim 1 wherein said forme cylinder is usable to print six side-by-side arranged printed pages.

11. The printing press of claim 10 wherein said six side-by-side arranged printed pages are newspaper pages in broadsheet format.

12. The printing press of claim 1 wherein all of said partial webs of material are conducted to said former.

13. The printing press of claim 1 wherein said former has a width of at least half of said web width, and further wherein said partial web having a partial web width of two thirds of said web width, is folded longitudinally centered by said former.

14. The printing press of claim 1 further including a press frame, said folder being fixed to said press frame.

15. The printing press of claim 1 further including a plurality of turning bars after said at least one longitudinal web cutting device and before said former in a direction of web travel, and means for moving at least one of said plurality of turning bars in a plane of said web to effect alignment of said partial webs with said former.

16. The printing press of claim 15 wherein all of said plurality of turning bars are movable in said plane.

17. The printing press of claim 1 further including an odd number of turning bars after said at least one longitudinal web cutting device and before said former, in a direction of web travel.

18. The printing press of claim 1 wherein said former has an effective width transversely to said former entry direction.

19. The printing press of claim 1 wherein said forme cylinder width is a maximum area of ink transfer.

20. A printing press adapted for imprinting a web of material and comprising:

a forme cylinder having a forme cylinder axis of rotation, said forme cylinder having a forme center width being equipped with printing plates of a number of N pages in width, said number N of pages being a natural number evenly divisible by three, said number N of pages having a combined page width less than said forme cylinder width, said number N of pages, plus one page having a width greater than said forme cylinder width said printing plates being adapted to print said number of rages on said web of material and having a maximum web width equal to said combined page width;

a press alignment direction of travel of a web of material being imprinted by said forme cylinder, said press alignment direction being perpendicular to said forme cylinder axis of rotation;

at least one longitudinal web cutting device usable to cut the web of material in said press alignment direction, said web of material having said maximum a web width not greater than said forme cylinder width, said at least one longitudinal web cutting device cutting said web into at least first and second partial webs of said material, each of said at least first and second partial webs of material each having a partial web width less than said maximum web width;

means for placing said at least one longitudinal web cutting device adjacent said forme cylinder and on a boundary between a $K^{th}$ and a $K^{th}$ plus one page printed on said web of material, wherein K is selected from one third and two thirds of N; and a former, at least one of said partial webs being conducted along a web path from said at least one longitudinal web cutting device and through said former for longitudinal folding of said at least one of said partial webs, said former having a former entry direction, in an area subsequent to said at least one longitudinal web cutting device, said former entry area extending transversely to said press alignment direction and parallel to said forme cylinder axis of rotation;

at least first and second turning bars in said web path between said at least one longitudinal web cutting device and said former; and an effective width of one of said at least first and second turning bars, said effective width being at least two-thirds of said maximum web width, one of said at least first and second partial webs of material, each having a partial web width of less than said maximum web width, being directed over said one of said at least first and second turning bars.

* * * * *

UNITED STATES PATENT AND TRADEMARK OFFICE

CERTIFICATE OF CORRECTION

PATENT NO. : 7,661,359 B2
APPLICATION NO. : 10/585449
DATED : February 16, 2010
INVENTOR(S) : Günther Oskar Eckert It is certified that error appears in the above-identified patent and that said Letters Patent is hereby corrected as shown below:

Column 8, in claim 3, line 64, after "said", delete "at";

Column 8, in claim 3, line 65, after "of" (first occurrence), change "one third" to --two thirds--;

Column 9, in claim 4, line 2, before "said", insert --two thirds of--;

Column 10, in claim 20, line 11, after "of", change "rages" to --pages--; and

Column 10, in claim 20, line 20, after "maximum", delete "a".

Signed and Sealed this

Eighth Day of June, 2010

David J. Kappos

David J. Kappos
*Director of the United States Patent and Trademark Office*